US005302280A

United States Patent [19]

Lomas et al.

[11] Patent Number: 5,302,280

[45] Date of Patent: * Apr. 12, 1994

[54] FLUIDIZED CATALYTIC CRACKING UTILIZING A VENTED RISER

[75] Inventors: David A. Lomas, Barrington; Paul A. Sechrist, Des Plaines; Edward C. Haun, Glendale Heights, all of Ill.

[73] Assignee: UOP, Des Plaines, Ill.

[ * ] Notice: The portion of the term of this patent subsequent to Apr. 14, 2009 has been disclaimed.

[21] Appl. No.: 973,465

[22] Filed: Nov. 9, 1992

Related U.S. Application Data

[63] Continuation-in-part of Ser. No. 801,208, Dec. 2, 1991, which is a continuation of Ser. No. 524,525, May 17, 1990, Pat. No. 5,104,517.

[51] Int. Cl.[5] ..... C10G 11/00

[52] U.S. Cl. ..... 208/113; 208/153; 208/164

[58] Field of Search ..... 208/113, 153, 164

[56] References Cited

U.S. PATENT DOCUMENTS

| | | | |
|---|---|---|---|
| 4,295,961 | 10/1981 | Fahrig et al. | 208/161 |
| 4,464,250 | 8/1984 | Meyers et al. | 208/120 |
| 4,479,870 | 10/1984 | Hammershaimb | 208/164 |
| 4,624,771 | 11/1986 | Lane et al. | 208/74 |
| 4,624,772 | 11/1986 | Krambeck et al. | 208/95 |
| 4,737,346 | 4/1988 | Haddad et al. | 422/144 |
| 4,764,268 | 8/1988 | Lane | 208/160 |
| 4,792,437 | 12/1988 | Hettinger et al. | 422/147 |
| 5,043,058 | 8/1991 | Forgac et al. | 208/48 |
| 5,087,349 | 2/1992 | Goelzer et al. | 208/113 |
| 5,087,427 | 9/1992 | Quinn et al. | 422/144 |
| 5,104,517 | 4/1992 | Lomas et al. | 208/113 |

*Primary Examiner*—R. Bruce Breneman
*Assistant Examiner*—Walter D. Griffin
*Attorney, Agent, or Firm*—Thomas K. McBride; John G. Tolomei

[57] ABSTRACT

An FCC process and apparatus is arranged to provide a low volume dilute disengagement zone in a reactor vessel and a quench zone immediately downstream of the reactor vessel. A vented riser that provides an open discharge of catalyst and gaseous products is directly discharged into a reactor vessel. The interior of the reactor vessel is arranged such that the outlet of the reactor riser is located close to and directed at the top of the reactor vessel. The reactor vessel operates with a dense bed of catalyst having an upper bed level that is only a short distance below the outlet of the reactor riser. The cyclone separators are located to the outside of the reactor riser and circulate catalyst back to the dense bed of the reactor section. The quenching takes place downstream of the cyclone separators.

16 Claims, 2 Drawing Sheets

FLUIDIZED CATALYTIC CRACKING UTILIZING A VENTED RISER

CROSS-REFERENCE TO RELATED APPLICATIONS

This application is a continuation in part of U.S. Ser. No. 801,208 filed on Dec. 2, 1991 which is a continuation of U.S. Ser. No. 524,525, filed on May 17, 1990 which was has issued as U.S. Pat. No. 5,104,517.

FIELD OF THE INVENTION

This invention relates generally to processes for the fluidized catalytic cracking (FCC) of heavy hydrocarbon streams such as vacuum gas oil and reduced crudes. This invention relates more specifically to a method for reacting hydrocarbons in an FCC reactor and separating reaction products from the catalyst used therein.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium. The FCC process is carried out by contacting the starting material whether it be vacuum gas oil, reduced crude, or another source of relatively high boiling hydrocarbons with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. During the cracking reaction, coke will be deposited on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The rate of conversion of the feedstock within the reaction zone is controlled by regulation of the temperature of the catalyst, activity of the catalyst, quantity of the catalyst (i.e., catalyst to oil ratio) and contact time between the catalyst and feedstock. The most common method of regulating the reaction temperature is by regulating the rate of circulation of catalyst from the regeneration zone to the reaction zone which simultaneously produces a variation in the catalyst to oil ratio as the reaction temperatures change. That is, if it is desired to increase the conversion rate, an increase in the rate of flow of circulating fluid catalyst from the regenerator to the reactor is effected.

The hydrocarbon product of the FCC reaction is recovered in vapor form and transferred to product recovery facilities. These facilities normally comprise a main column for cooling the hydrocarbon vapor from the reactor and recovering a series of heavy cracked products which usually include bottom materials, cycle oil, and heavy gasoline. Lighter materials from the main column enter a concentration section for further separation into additional product streams.

Improvements in the reduction of product losses and the control of regeneration temperatures have been achieved by providing multiple stages of catalyst stripping and raising the temperature at which the catalyst particles are stripped of products and other combustible compounds. Both of these methods will increase the amount of low molecular weight products that are stripped from the catalyst and will reduce the quantity of combustible material in the regenerator. A variety of arrangements are known for providing multiple stages of stripping and heating the spent catalyst to raise the temperature of the stripping zone. With increasing frequency it is being proposed to raise the temperature of the stripping zone by mixing the spent catalyst with hot regenerated catalyst from the regeneration zone.

As the development of FCC units has advanced, temperatures within the reaction zone were gradually raised. It is now commonplace to employ temperatures of about 525° C. (975° F.). At higher temperatures, there is generally a loss of gasoline components as these materials crack to lighter components by both catalytic and strictly thermal mechanisms. At 1025° F. (550° C.), it is typical to lose 1% on the potential gasoline yield due to gasoline components thermally cracking into lighter hydrocarbon gases. As temperatures increase, to say 1075° F. (580° C.), most feedstocks lose up to 6% or more of the gasoline yield due to thermal cracking of gasoline components. Quench systems have been used to reduce the temperature of the cracked vapors downstream of an FCC reaction zone.

One improvement to FCC units, that has reduced the product loss by thermal cracking, is the use of riser cracking. In riser cracking, regenerated catalyst and starting materials enter a pipe reactor and are transported upward by the expansion of the gases that result from the vaporization of the hydrocarbons, and other fluidizing mediums if present, upon contact with the hot catalyst. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser designs use a lift gas as a further means of providing a uniform catalyst flow. Lift gas is used to accelerate catalyst in a first section of the riser before introduction of the feed and thereby reduces the turbulence which can vary the contact time between the catalyst and hydrocarbons.

The benefits of using lift gas to pre-accelerate and condition regenerated catalyst in a riser type conversion zone are well known. Lift gas typically has a low concentration of heavy hydrocarbons, i.e. hydrocarbons having a molecular weight of $C_3$ or greater are avoided. In particular, highly reactive type species such as $C_3$ plus olefins are unsuitable for lift gas. Thus, lift gas streams comprising steam and light hydrocarbons are generally used.

Riser cracking whether with or without the use of lift gas has provided substantial benefits to the operation of the FCC unit. These can be summarized as a short contact time in the reactor riser to control the degree of cracking that takes place in the riser and improved mixing to give a more homogeneous mixture of catalyst and feed. A more complete distribution prevents different times for the contact between the catalyst and feed over the cross-section of the riser such that some of the feed contacts the catalyst for a longer time than other portions of the feed. Both the short contact time and a more uniform average contact time for all of the feed with the catalyst has allowed overcracking to be controlled or eliminated in the reactor riser.

Unfortunately, much of what can be accomplished in the reactor riser in terms of uniformity of feed contact and controlled contact time can be lost when the catalyst is separated from the hydrocarbon vapors. As the catalyst and hydrocarbons are discharged from the riser, they must be separated. In early riser cracking operations, the output from the riser was discharged into a large vessel. This vessel serves as a disengaging chamber and is still referred to as a reactor vessel, although most of the reaction takes place in the reactor riser. The reactor vessel has a large volume. Vapors that enter the reactor vessel are well mixed in the large volume and therefore have a wide residence time distribution that results in relatively long residence times for a significant portion of the product fraction. Product fractions that encounter extended residence times can undergo additional catalytic and thermal cracking to less desirable lower molecular weight products.

In an effort to further control the contact time between catalyst and feed vapors, there has been continued investigation into the use of cyclones that are directly coupled to the end of the reactor riser. This direct coupling of cyclones to the riser provides a quick separation of most of the product vapors from the catalyst. Therefore, contact time for a large portion of the feed vapors can be closely controlled. One problem with directly coupling cyclones to outlet of the reactor riser is the need for a system that can handle pressure surges from the riser. These pressure surges and the resulting transient increase in catalyst loading inside the cyclones can overload the cyclones such that an unacceptable amount of fine catalyst particles are carried over with the reactor vapor into downstream separation facilities. Therefore, a number of apparatus arrangements have been proposed for direct coupled cyclones that significantly complicate the arrangement and apparatus for the direct coupled cyclones, and either provide an arrangement where a significant amount of reactor vapor can enter the open volume of the reactor/vessel or compromise the satisfactory operation of the cyclone system by subjecting it to the possibility of temporary catalyst overloads.

Although direct coupled cyclone systems can help to control contact time between catalyst and feed vapors, they will not completely eliminate the presence of hydrocarbon vapors in the open space of a reactor vessel. Product vapors are still present in this open space from the stripped hydrocarbon vapors that are removed from the catalyst and pass upwardly into an open space above the stripping zone. The amount of hydrocarbon vapors is also increased by direct coupled cyclone arrangements that allow feed vapors to enter the open space that houses the cyclones. Since the dilute phase volume of the reactor vessel remains unchanged when direct coupled cyclones are used and less hydrocarbon vapors enter the dilute phase volume from the riser, the hydrocarbon vapors that do enter the dilute phase volume will be there for much longer periods of time when a direct coupled cyclone system is used. (The terms "dense phase" and "dilute phase" catalysts as used in this application are meant to refer to the density of the catalyst in a particular zone. The term "dilute phase" generally refers to a catalyst density of less than 20 $lbs/ft^2$ and the term "dense phase" refers to catalyst densities above 30 $lbs/ft^2$. Catalyst densities in the range of 20 to 30 $lbs/ft^2$ can be considered either dense or dilute depending on the density of the catalyst in adjacent zones or regions.) In other words, when a direct coupled cyclone system is used, less product vapors may enter the open space of the reactor vessel, but these vapors will have a much longer residence time in the reactor vessel. As a result, any feed components left in the reactor vessel are substantially lost to overcracking.

The very low gas flow rate through the reactor vessel can also promote coke deposition on the interior of the vessel. The long residence time of heavy hydrocarbons at relatively high temperature in the upper section of the reactor vessel promotes the formation of coke. These coke deposits interfere with the function of the reactor vessel by forming thick deposits on the interior of the vessel thereby insulating and locally cooling portions of the metal shell. Such locally cooled portions promote the condensation of corrosive materials that can damage the reactor vessel. In addition, other problems are created by the large coke deposits which can, from time to time, break off in large chunks and block the flow of catalyst through the vessels or conduits.

One apparatus that has been known to promote quick separation between the catalyst and the vapors in the reactor vessels is known as a ballistic separation device which is also referred to as a vented riser. The structure of the vented riser in its basic form consists of a straight portion of conduit at the end of the riser and an opening that is directed upwardly into the reactor vessel with a number of cyclone inlets surrounding the outer periphery of the riser near the open end. The apparatus functions by shooting the high momentum catalyst particles past the open end of the riser where the gas collection takes place. A quick separation between the gas and the vapors occurs due to the relatively low density of the gas which can quickly change directions and turn to enter the inlets near the periphery of the riser while the heavier catalyst particles continue along a straight trajectory that is imparted by the straight section of riser conduit. The vented riser has the advantage of eliminating any dead area in the reactor vessel where coke can form while providing a quick separation between the catalyst and the vapors. However, the vented riser still has the drawback of operating within a large open volume in the reactor vessel.

DISCLOSURE STATEMENT

U.S. Pat. No. 4,792,437 discloses a ballistic separation device.

U.S. Pat. No. 4,295,961 shows the end of a reactor riser that discharges into a reactor vessel and an enclosure around the riser that is located within the reactor vessel.

U.S. Pat. No. 4,737,346 shows a closed cyclone system for collecting the catalyst and vapor discharge from the end of a riser.

U.S. Pat. No. 4,624,771, issued to Lane et al. on Nov. 25, 1986, discloses a riser cracking zone that uses fluidizing gas to pre-accelerate the catalyst, a first feed introduction point for injecting the starting material into the flowing catalyst stream, and a second downstream fluid injection point to add a quench medium to the flowing stream of starting material and catalyst.

U.S. Pat. No. 4,624,772, issued to Krambeck et al. on Nov. 25, 1986, discloses a closed coupled cyclone system that has vent openings, for relieving pressure surges, that are covered with weighted flapper doors so that the openings are substantially closed during normal operation.

U.S. Pat. No. 4,479,870, issued to Hammershaimb et al. on Jun. 30, 1984, teaches the use of lift gas having a specific composition in a riser zone at a specific set of flowing conditions with the subsequent introduction of the hydrocarbon feed into the flowing catalyst and lift gas stream.

U.S. Pat. No. 4,464,250, issued to Maiers et al. and U.S. Pat. No. 4,789,458, issued to Haddad et al. teach the heating of spent catalyst particles to increase the removal of hydrocarbons, hydrogen and/or carbon from the surface of spent catalyst particles by heating the catalyst particles after initial stripping of hydrocarbons in the stripping zone of an FCC unit.

U.S. Pat. No. 4,764,268 shows a riser conversion zone in an FCC unit with a quench located at the top of the riser to reduce the temperature of the vapor and catalyst mixture before it enters a reactor vessel.

U.S. Pat. No. 5,087,427 shows the quenching of cracked vapors in an open FCC reaction zone downstream of a first cyclone separator and upstream of a second cyclone separator.

U.S. Pat. No. 5,043,058 teaches an FCC reactor arrangement that quenches cracked vapors from an FCC riser downstream of a rough cut cyclone and transfers the quenched vapors to a disengaging vessel from where vapors are withdrawn through an additional cyclone.

BRIEF DESCRIPTION OF THE INVENTION

It is an object of this invention to reduce the hydrocarbon residence time in a reactor vessel.

It is another object of this invention to improve the operation of a vented riser in the separation of catalyst and hydrocarbon vapors.

A further object of this invention is to control the residence time in a reactor vessel section of an FCC reaction zone.

A yet further object of this invention is to control the production of light cracked gases by the use of a highly effective quench.

This invention is an FCC process that is arranged so that the outlet end of a reactor riser discharges into an upper portion of a reactor vessel that functions as an open disengagement zone and the discharge end of the reactor riser is located near the top of a dense catalyst bed in the reactor vessel. This arrangement is facilitated by putting the cyclones or gas solid separators on the outside of the reactor vessel. It has been discovered that when a vented riser is used in combination with externally located cyclones or separation devices the upper level of a dense catalyst bed can be maintained near the top of a reactor vessel. The high level of the dense catalyst bed relative to the riser outlet reduces the dilute phase volume in the disengagement vessel so that hydrocarbon residence time is reduced and the reactor vessel height required above the dense bed level is decreased. In addition cracked vapors are quickly separated from the low volume disengaging vessel with very low catalyst loadings through a conduit that provides ready access to a quench medium just upstream of the external cyclones.

The decreased height of the dilute phase in the reactor vessel offers a number of benefits. The decreased dilute phase height can shorten the reactor vessel and its overall elevation. Alternatively, the overall elevation of the reactor vessel can be maintained and the additional height can be used to maintain a longer vertical length for the dense catalyst phase. Additional catalyst stripping can be performed in the additional length of dense catalyst bed. In addition, an increased height of dense catalyst increases the pressure drop between the reactor vessel and the regenerator control valve so that higher regenerator pressures can be maintained without raising the pressure in the reactor zone. The dense bed level is also susceptible to a substantial degree of variation so that the overall residence time of hydrocarbon vapors in the reactor vessel can be adjusted. This permits the use of very short residence time for certain feedstocks and an increase in residence time for more refractory feedstocks without a variation in the feed rate to the reactor riser. These benefits show that this invention will provide much of the same improvement offered by direct coupled cyclones in regard to reducing overcracking while giving a much greater degree of flexibility that is combined with the increased reliability of an open discharge type reactor riser.

The quick catalyst separation provided by the reactor arrangement permits the use of a quench in a highly advantageous location. Immediately downstream of the disengaging section the cracked vapors have a low catalyst concentration so that a relatively small amount of quench can quickly lower the temperature of the vapors.

Quenching is also readily accomplished in a small conduit which decreases the lag time for the temperature reduction by promoting rapid mixing. Furthermore the low volume of catalyst downstream of the reactor vessel minimizes the possibility for adsorption of the quench fluid, particularly when it includes relatively heavy hydrocarbons.

Accordingly in one embodiment, this invention is a process for the fluidized catalytic cracking of an FCC feedstock. The process includes the steps of passing the FCC feedstock and regenerated catalyst particles to a reactor riser, transporting the catalyst and feedstock upwardly through the riser thereby converting the feedstock to a gaseous product stream, and producing spent catalyst particles by the deposition of coke on the regenerated catalyst. The mixture of spent catalyst particles and gaseous products are discharged into a reactor vessel in an upward direction from a discharge end of the riser located less than about 8 riser diameters below the upper end of the reactor vessel thereby providing an initial separation of the spent catalyst from the gaseous products. The separated catalyst passes downward through the vessel where it is maintained as a dense catalyst bed while a stripping gas passes upwardly through the reactor vessel. The upper surface of the bed is a distance of less than 16 feet from the outlet end of the riser. The spent catalyst particles pass downwardly through the reactor vessel into a stripping zone where they are contacted with the stripping gas. A mixture of gaseous products, stripping fluid and spent catalyst particles is withdrawn from the reactor vessel and transferred to a particle separator that is located outside of the reactor vessel wherein the gaseous components are separated from the spent catalyst which is ultimately returned to the regeneration zone. Spent catalyst particles are passed from the stripping zone into a regeneration zone and contacted therein with a regeneration gas in the regeneration zone to combust coke from the catalyst particles and produce regenerated catalyst particles for transfer to the reactor riser. The mixture withdrawn from the reactor vessel is quenched before entering the particle separator located outside of the reactor vessel.

In a more limited embodiment, this invention is again a process for the fluidized catalytic cracking of an FCC feedstock. The process includes the steps of passing an FCC feedstock and regenerated catalyst particles to a reactor riser and transporting the catalyst and feedstock upwardly through the riser to convert the feedstock to a gaseous product stream and produce spent catalyst particles by the deposition of coke on the regenerated catalyst particles. The mixture of spent catalyst particles and gaseous products are discharged into a reactor vessel in an upward direction from a discharge end of a riser located from about 1 to 8 riser diameters below the upper end of the reactor vessel to perform an initial separation of the spent catalyst from the gaseous products. The separated catalyst is passed downward through the vessel at an average rate of less than 20 $lb/ft^2/sec$. The separated catalyst is maintained in the reactor vessel as a dense catalyst bed by passing a stripping gas upwardly through the reactor vessel at an average superficial velocity of less than 1 ft/sec., preferably less than 0.5 ft/sec. The upper surface of the catalyst bed is maintained a minimum distance of 3 to 16 feet from the outlet end of the riser. A second mixture of gaseous products, stripping fluid and spent catalyst particles are withdrawn from the reactor vessel and transferred to a particle separator located outside the reactor vessel. Gaseous components are separated from the spent catalyst in the separator and the spent catalyst is returned to the reactor vessel. The spent catalyst is passed downwardly through the reactor vessel into a stripping zone and contacted with a stripping gas. After stripping, the spent catalyst is passed to a regeneration zone to combust coke from the catalyst particles and produce regenerated catalyst for transfer to the reactor riser. The second mixture undergoes quenching in a transfer conduit between the reactor vessel and the external particle separator.

This invention can also be described in the context of an apparatus. The apparatus includes an upwardly directed riser conduit having an upwardly directed outlet end, a reactor vessel that surrounds the outlet end and has an upper end located 1 to 8 riser diameters above the outlet end of the riser. Gas solids separation devices are located outside of the reactor vessel and these devices have an inlet, a gas outlet and a solids outlet. Means are provided for collecting a mixture of gas and catalyst from the upper half of the reactor vessel and communicating the mixture of catalyst and gas to the inlet of the separation device. Means are provided for returning catalyst particles from the collector to the reactor vessel, and means are provided for withdrawing catalyst from the bottom of the reactor vessel and transferring the catalyst to a regeneration vessel. Means are also provided for quenching gases that pass from the reactor vessel to the separation devices located outside the reactor vessel.

Other objects, embodiments and details of this invention are set forth in the following detailed description of the invention.

DETAILED DESCRIPTION OF THE INVENTION

This invention relates generally to the reactor side of the FCC process. This invention will be useful for most FCC processes that are used to crack light or heavy FCC feedstocks. The process and apparatus aspects of this invention can be used to modify the operation and arrangement of existing FCC units or in the design of newly constructed FCC units.

This invention uses the same general elements of many FCC units. A reactor riser provides the primary reaction zone. A reactor vessel and cyclone separators remove catalyst particles from the gaseous product vapors. A stripping zone removes a large percentage of sorbed hydrocarbons from the surface of the catalyst. Spent catalyst from the stripping zone is regenerated in a regeneration zone having one or more stages of regeneration. Regenerated catalyst from the regeneration zone is used in the reactor riser. A number of different arrangements can be used for the elements of the reactor and regenerator sections. The description herein of specific reactor and regenerator components is not meant to limit this invention to those details except as specifically set forth in the claims.

Figure 1:
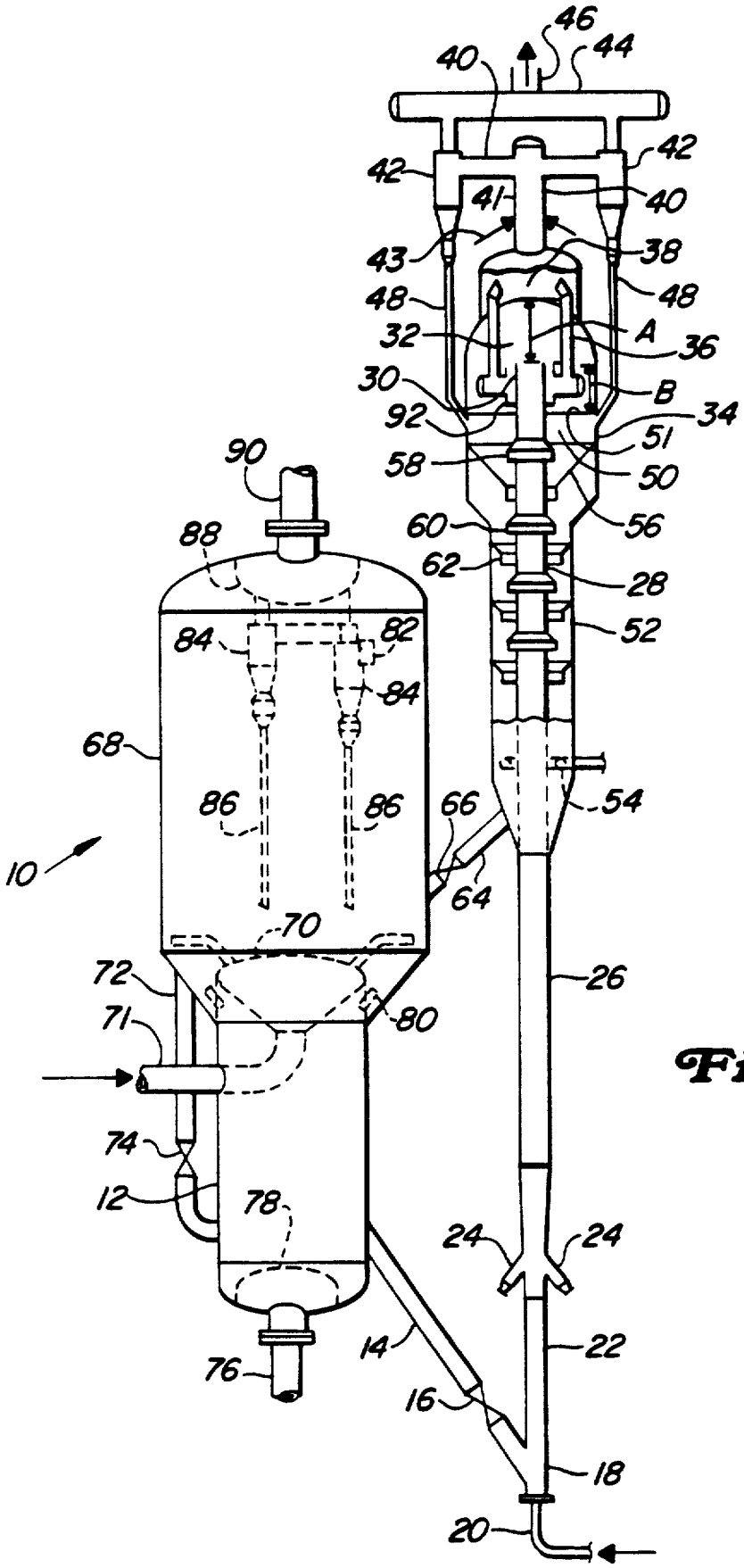
FIG. 1 shows a reactor/regenerator system for an FCC process arranged in accordance with this invention.

An overview of the basic process operation can be best understood with reference to FIG. 1. Regenerated catalyst from a lower portion 12 of a regeneration vessel 10 is transferred by a conduit 14, at a rate regulated by a control valve 16, to a Y-section 18. Lift gas injected into the bottom of Y-section 18, by a conduit 20, carries the catalyst upward through a lower riser section 22. Feed is injected into the riser above lower riser section 22 by feed injection nozzles 24.

The mixture of feed, catalyst and lift gas travels up an intermediate section of the riser 26 and into an upper internal riser section 28 that terminates in an upwardly directed outlet end 30 that is located in a dilute phase region 32 of a reactor vessel 34. The gas and catalyst are separated in dilute phase section 32. Conduits 36 collect gas from the dilute phase section and transfer it to a collection chamber 38. From collection chamber 38, a T-type piping arrangement 40 distributes the gas which still contains a small amount of catalyst particles to a pair of cyclone separators 42. The T-type piping arrangement includes a single conduit 41 into which one or more quench lines 43 inject a quench fluid. Cooled and relatively clean product vapors are recovered from the outlets of cyclones 42 by a manifold 44 and withdrawn from the process through an outlet 46. Catalyst separated by cyclone separators 42 is carried back to reactor vessel 34 by dip pipe conduits 48. Spent catalyst from dilute phase section 32 and the dip pipe conduits form a dense catalyst bed 50 in a lower portion of the reactor vessel 34. The dense catalyst bed extends downward into a stripping vessel 52 that operates as a stripping zone. Stripping fluid enters a lower portion of the stripping vessel 52 through a distributor 54 and travels upward through the stripping vessel and reactor vessel in countercurrent flow to the downward moving catalyst. As the catalyst moves downward, it passes over reactor stripping baffles 56 and 58 and stripper baffles 60 and 62 and is transferred into an upper section 68 of the regenerator vessel 10 by a conduit 64 at a rate regulated by a control valve 66. The catalyst particles are contacted with an oxygen-containing gas in upper section 68 of the regeneration zone. A distributor 70 receives the oxygen-containing gas from a conduit 71 and distributes the gas over the cross-section of the regeneration vessel. Regenerated catalyst is withdrawn from upper section 68 and transferred by a conduit 71 and distributes the gas over the cross-section of the regeneration vessel. Regenerated catalyst is withdrawn from upper section 68 and transferred by a conduit 72 into lower portion 12 of the regeneration vessel at a rate regulated by a control valve 74. Catalyst in the lower portion 12 is contacted with additional regeneration gas that enters the vessel through conduit 76 and is distributed over the cross-section of the vessel by dome style distributor 78. Catalyst in lower section 12 is fully regenerated and withdrawn by conduit 14 in the manner previously described. The products of coke combustion in the lower regeneration section 12 rise upwardly and flow into the upper regenerator section 68 through a series of internal vents 80. Flue gas from lower section 12 is mixed with flue gas generated in upper section 68 and withdrawn through an inlet 82 of cyclones 84. The flue gas entering cyclone 84 contains a small amount of fine catalyst particles that are removed by the cyclones and returned to the regenerator by dip legs 86. Flue gas leaving the cyclones is collected in a chamber 88 that leaves the regenerator through a conduit 90.

The reactor riser of this invention is laid out to perform an initial separation between the catalyst and gaseous components in the riser. The term "gaseous components" includes lift gas, product gases and vapors, and unconverted feed components. The drawing shows this invention being used with a riser arrangement having a lift gas zone 22. It is not necessary that a lift gas zone be provided in the riser in order to enjoy the benefits of this invention. However, the end of the riser must terminate with one or more upwardly directed openings that discharge the catalyst and gaseous mixture in an upward direction into a dilute phase section of the reactor vessel. The open end of the riser can be of an ordinary vented riser design as described in the prior art patents of this application or of any other configuration that provides a substantial separation of catalyst from gaseous material in the dilute phase section of the reactor vessel. It is believed to be important that the catalyst is discharged in an upward direction in order to minimize the distance between the outlet end of the riser and the top of the dense phase catalyst bed in the reactor vessel. The flow regime within the riser will influence the separation at the end of the riser. Typically, the catalyst circulation rate through the riser and the input of feed and any lift gas that enters the riser will produce a flowing density of between 3 $lbs/ft^3$ to 20 $lbs/ft^3$ and an average velocity of about 10–100 ft/sec. for the catalyst and gaseous mixture. The length of the riser will usually be set to provide a residence time of between 0.5 to 5 seconds at these average flow velocity conditions.

The velocity at which the catalyst and gaseous mixtures discharge from end 30 of the riser also influences the placement of the end of the riser relative to the top of the reactor vessel. This distance indicated by the letter "A" in the drawing is set on the basis of the flow rate to riser. In the interest of minimizing the dilute volume of catalyst in the reactor vessel, distance "A" should be kept as short as possible. Nevertheless, there is need for some space between the end of the riser to avoid direct impingement and the resulting erosion of the top of the reactor vessel and to allow the discharge of catalyst from the end of the riser to provide a separation while preventing the re-entrainment of catalyst particles that are separated by the initial discharge from the riser with the gas stream that is collected from the upper section of the reactor vessel. Since the reactor riser is usually designed for a narrow range of exit velocities between 20 to 100 ft/sec., distance "A" can be set on the basis of riser diameter. In order to avoid erosion of the upper surface of the reactor vessel and to promote the initial separation of the catalyst from the gaseous components, the distance "A" should equal 5 to 12 riser diameters. It is also possible to avoid erosion by the use of abrasion resistant linings and therefore reduce the length of dimension A. A reduced distance for dimension A has the advantage of further reducing the dilute volume of the catalyst. The avoidance of catalyst re-entrainment after discharge of catalyst and vapors from the riser is influenced by both the riser velocity and the flowing density of the catalyst as it passes downwardly through the reactor vessel. For most practical ranges of catalyst density in the riser, the distance of 1 to 8 riser diameters for dimension "A" is adequate for a flowing catalyst density, often referred to as "catalyst flux", of about 50–200 $lb/ft^2/sec$.

The total dilute phase volume in the reactor vessel is determined by the diameter of the reactor vessel, the distance from the end of the riser to the top of the reactor vessel, dimension "A", and the distance from the discharge end of the riser to the top of the dense bed level in the reactor vessel which is shown as dimension "B" in the FIG. 1. In order to prevent re-entrainment of catalyst particles into the gases that are withdrawn from the reactor vessel, a minimum distance is required from the top of the reactor riser to the top of the catalyst bed level. This dimension is primarily influenced by the superficial velocity of gases that flow upwardly through dense bed 50. In order to minimize the potential for re-entrainment of the gaseous compounds passing through bed 50, the superficial velocity is typically below 0.5 ft/sec. The gaseous components passing upward through bed 50 are made up of stripping fluid and hydrocarbons that are desorbed from the surface of the catalyst. The amount of stripping gas that enters the stripping vessel is usually proportional to the volume of voids in the catalyst. For most reasonable catalyst to oil ratios in the riser, the amount of stripping gas that must be added to displace the void volume of the catalyst will not exceed 6 wt % of the feed rate. Accordingly, the relative ratio of catalyst passing downwardly through the reactor vessel and the stripping fluid as well as other displaced hydrocarbons flowing upwardly through the reactor vessel will remain relatively constant. Thus, the primary variable in controlling the superficial gas velocity upward through the dense catalyst bed is the diameter of the reactor vessel. As long as the superficial velocity of the gases rising through bed 50 are kept in a range of from 1 to 0.1 ft/sec., a distance "B" of about 3 to 16 feet will prevent reentrainment of the catalyst and gases that are leaving the reactor vessel. Preferably, the superficial velocity will be below 0.5 ft/sec. and the distance "B" will have a length of from 3 to 8 feet. For most reactor risers, the 3 to 8 feet will equal approximately 1 to 4 riser diameters.

The manner in which the gaseous vapors are withdrawn from the dilute phase volume of the reactor vessel will also influence the initial separation and the degree of re-entrainment that is obtained in the reactor vessel. In order to improve this disengagement and avoid re-entrainment, the Figure shows the use of an annular collector 92 that surrounds the end 30 of the riser. Collector 92 is supported from the top of the reactor vessel 34 by withdrawal conduits 36. Withdrawal conduits 36 are symmetrically spaced around the annular collector and communicate with the annular collector through a number of symmetrically spaced openings to obtain a balanced withdrawal of gaseous components around the entire circumference of the reactor riser. All of the stripping gas and gaseous components from the reactor riser are withdrawn by annular collector 92 for the process arrangement shown in the Figure. All of the product gases from conduits 36 are transferred to the cyclones 42.

The Figure shows an arrangement for transferring gases from the conduits 36 to the cyclones that avoids a mal-distribution of the catalyst and gas mixture to the different cyclones. The simplest way to connect the gas conduits with the cyclones is to directly couple one conduit to a corresponding cyclone. This arrangement would also have the advantage of minimizing the flow path between the annular collector of the riser and the cyclones where the final separation of catalyst and gas is performed. However, for reasons related to the complex hydrodynamics in the dilute phase region 32, it has been found that mixtures of catalyst and gas that are taken from the reactor through a series of conduits may preferentially flow to one conduit. The resulting heavier loading of catalyst and gas can overload the cyclone to which it is directed. For this reason, the Figure shows the use of a chamber 38 that commonly collects the gas from all cyclone conduits 36 and redistributes the gas to the individual cyclones. Although providing chamber 38 and T-section 40 increases the residence time for the catalyst and gas mixture as it flows from the reactor vessel to the cyclone inlets, this minor increase in residence time will not have a substantial impact on the quality of the product recovered from the cyclones. The avoidance of maldistribution may also be accomplished by the use of a catalyst and gas separation device other than cyclones.

Figure 2:
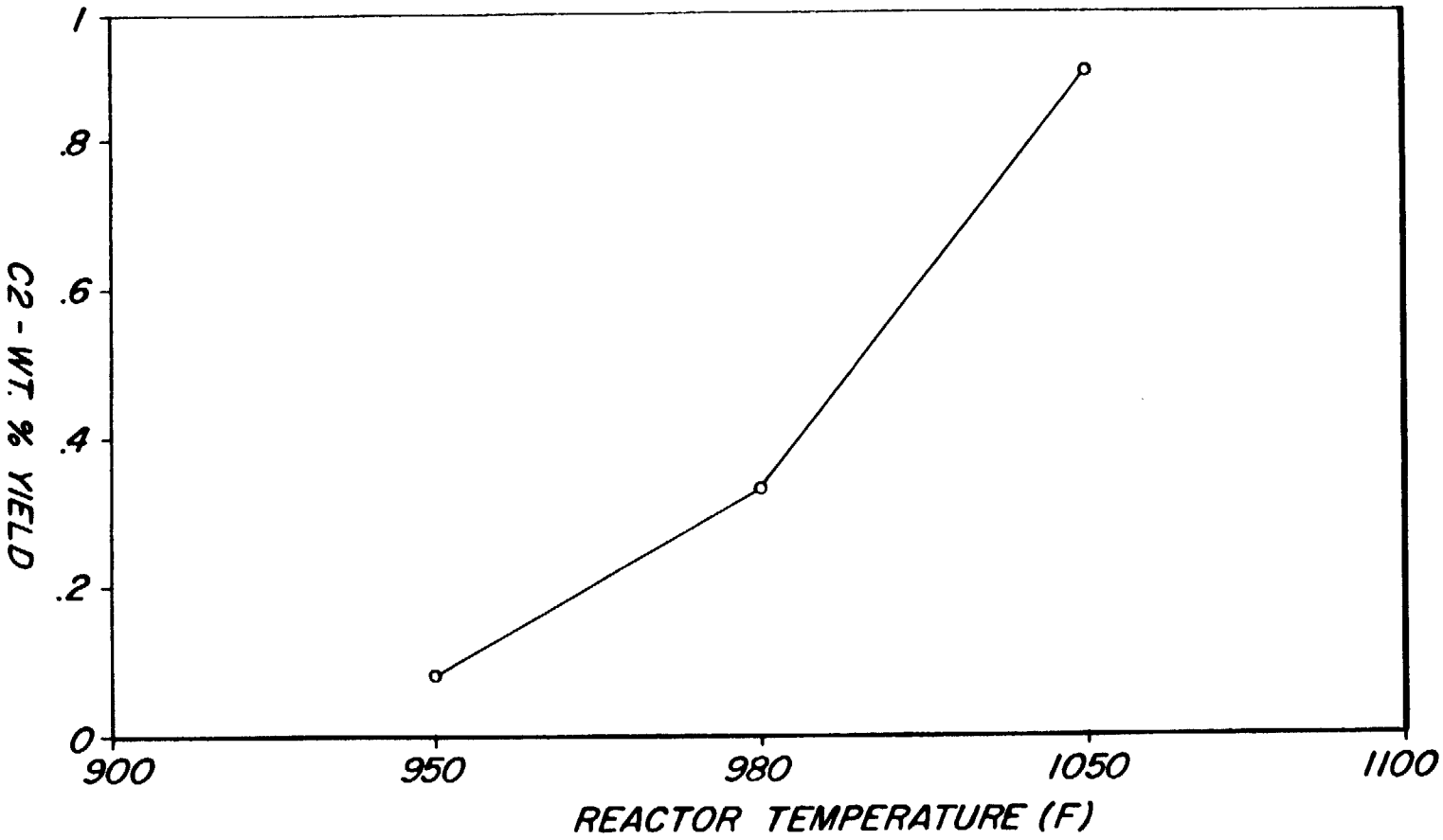
FIG. 2 is a graph of reactor temperature versus $C_2$-yield.

A quench fluid contacts vapor products passing from withdrawal conduits 36 to cyclones 42. It has been found experimentally that high temperature fluid catalytic cracking (i.e. operating above 950° F.) undergoes dramatic product degradation due to thermal cracking. FIG. 2 graphically illustrates the data establishing the loss of product hydrocarbons to light gases. The data for FIG. 2 was established by contacting a reactor effluent stream comprising a representative FCC product stream of $C_5$ and higher hydrocarbons with inert solids for a residence time of one second at temperatures in the range of 950°-1050° F. The yield of $C_2$-gases falls rapidly with a decrease in temperature from 1050°-950° F. Therefore, the quench fluid needs to contact the reactor vapors as rapidly as possible to diminish thermal cracking effects. The amount of quench fluid added to the reactor vapors will reduce the temperature of the reactor vapors by at least 20° F., and more preferably 80° F. or more.

Any lowering of the reactor vapor stream temperature will decrease product losses. Accordingly contacting the reactor vapors with the quench at any point downstream of the riser will produce some benefit. Contacting reactor vapors after substantial removal of the catalyst particles minimizes the volume of quench needed to achieve a desired degree of cooling and the amount of quench lost by adsorption on the catalyst. The quick separation arrangement of this invention provides a particularly advantageous arrangement for use of a quench. The ballistic separation of the riser effluent provides faster separation of the catalyst from the vapor than normally attained by the use of cyclones. The rapidly separated vapors from the ballistic separation section exit with only minor catalyst particle loading, typically on the order of 0.1-1.0 lb/ft$^3$. Rapid separation and efficient separation minimizes thermal cracking as well as volumetric requirements of quench fluid.

The quench fluid can contact the product vapors at any point between the inlets for withdrawal conduits 36 and the cyclones 42. Mixing of the quench fluid with the product vapors downstream of cyclones 42 can add from 0.5 to 5 seconds of high temperature exposure to the product vapors. Secondary cyclones, such as cyclones 42 typically have a high volume which exacerbates the problem of extended residence time. The most rapid quenching is obtained by contacting the quench stream immediately downstream of the ballistic separation. Quench fluid can contact the reactor vapors by addition into cup 92, conduit 36, chamber 38, conduit 40 or any other location downstream of cyclones 42 and upstream of the ballistic separation section. The quench medium can be passed to a contacting location inside the reactor vessel such as cup 92, conduit 36 as shown in FIG. 1. This invention also applies to an arrangement where the secondary separation device, such as cyclones 42, is located within the reactor vessel and the only locations for quench contacting are inside the reactor vessel. In the preferred form of this invention the quench enters single conduit 41. Addition of quench to single conduit 41 has the advantage of providing a location external to the reactor vessel for the addition of quench as well as offering a relatively small cross-sectional area for immediate and complete mixing of the quench fluid with the vapors.

A wide variety of quench fluids are suitable for use in this process. Preferred quench streams comprise light cycle oil, heavy cycle oil, and heavy naphtha. The quench fluid may enter the reactor vapor flow path in liquid or gaseous form. A liquid phase quench is generally preferred and will usually have an initial temperature of 300°-700° F. Following contact, the high temperature of the reactor vapors instantaneously vaporize the quench material. To achieve the Preferred range of temperature reduction, the volume of quench added equals about 3 to 20 vol. % of the product vapors.

After quenching, cyclones 42 recover remove any remaining catalyst from the quenched vapors. Catalyst recovered by the cyclones can be returned to the process at any convenient location. Whatever type of gas and catalyst separation device is utilized, the catalyst separated therefrom is returned to the process. The catalyst may be returned to any point of the process that puts it back into the circulating inventory of catalyst. The drawing shows the use of conventional cyclones with the dip legs 48 returning near the upper bed level 51 of dense bed region 50. Preferably, the catalyst will be returned to the dense bed in the reactor vessel or stripping vessel.

With the cyclones removed from the reactor vessel, the diameter of the reactor vessel is no longer affected by the need to provide adequate space for a separation device therein. Accordingly, the diameter of the reactor vessel can be set on the basis of the superficial velocity of gas passing upward through the dense bed and the catalyst flux entering the reactor vessel. The criteria for both of these parameters, as previously discussed, will permit the use of a smaller reactor diameter than has been found in the prior art. The smaller reactor vessel diameter further decreases the volume of the dilute phase in the reactor vessel. When this invention is used with a new reactor vessel, the diameter can be kept low enough such that the average residence time in the dilute phase of the reactor vessel will be less than three seconds. Again, since the superficial velocity and catalyst flux are influenced by a well-known range of catalyst density and velocity conditions in the riser, the diameter of the reactor vessel when initially designed in accordance with this invention will preferably be between three and five times the diameter of the riser. Alternately the dilute phase volume of the reactor vessel above the top of the catalyst bed can be kept to less than five times the volume of the reactor riser through which the feed passes.

Catalyst that is initially separated from the gaseous components as it enters the reactor vessel, passes downwardly through the vessels as previously described. As this catalyst progresses through the vessel, it preferably contacts a series of baffles that improve the contact of the catalyst with a stripping gas that passes upwardly through the vessel. In the embodiment of the invention shown in the Figure, the catalyst passes through a stripping section in the upper portion of the vessel and a separate stripping vessel located therebelow. The Figure shows the baffles 56 and 62 located on the exterior of the vessel walls and baffles 58 and 60 located down the length of the riser through the lower portion of the reactor vessel and the stripping vessel. These stripping baffles function in the usual manner to cascade catalyst from side to side as it passes through the vessel and increase the contact of the catalyst particles with the stripping stream as it passes upward in countercurrent contact with the catalyst. Dense bed 50 has a relatively long length in reactor vessel 34. There is no requirement for a long dense bed length in the reactor vessel and the dense bed length shown in the Figure stems from the type of arrangement depicted in the Figure. The Figure depicts a retrofit of this invention into an existing regeneration and reactor section where the tangent length of the reactor vessel was set by the previous arrangement that place the cyclone separators inside the reactor vessel. When the method of this invention is employed in the initial design of a reactor vessel, the tangent length can be substantially reduced so that upper bed level 51 is near the top of a stripper vessel.

Nevertheless, the height of the dense catalyst bed in the reactor 34 increases the total height of the dense phase catalyst above control valve 66. This additional height of dense bed catalyst can be used advantageously in the FCC process. First, the additional length of dense bed catalyst provides an elongated region for increased contact between the stripping fluid and the catalyst. Therefore, a greater degree of stripping can be obtained by the extended length of the dense catalyst bed. In addition, the hydrostatic head of catalyst from the top surface 51 to control valve 66 produces a relatively high pressure drop between control valve 66 and bed level 51. This pressure drop can total 7 psi or more. This additional pressure allows the regenerator to be operated at a higher pressure than the reactor section. As previously described, there are substantial benefits to operating the regeneration zone at higher pressures and the reaction zone at lower pressures.

The additional height of dense bed can also be used to incorporate a hot stripping section. The hot stripping section will utilize catalyst from the regeneration zone to supply heat to the stripping section and increase the desorption of hydrocarbons and volatile components from the surface of the catalyst. A suitable lift system can be used to transport the catalyst upward from the regeneration zone into a stripping zone at a desired elevation.

The catalyst is withdrawn from the stripping zone and transferred to a regeneration zone. Any well-known regenerator arrangement for removing coke from the catalyst particles by the oxidative combustion of coke and returning catalyst particles to the reactor riser can be used. As a result, the particular details of the regeneration zone are not an important aspect of this invention.

The foregoing description sets forth essential features of this invention which can be adapted to a variety of applications and arrangements without departing from the scope and spirit of the claims hereafter presented.

We claim:

1. A process for the fluidized catalytic cracking (FCC) of an FCC feedstock, said process comprising:

a) passing said FCC feedstock and regenerated catalyst particles to a reactor riser and transporting said catalyst and feedstock upwardly through said riser thereby converting said feedstock to a gaseous product stream and producing spent catalyst particles by the deposition of coke on said regenerated catalyst particles;

b) discharging a first mixture of spent catalyst particles and gaseous products directly into the dilute phase of a reactor vessel in an upward direction from a discharge end of said riser located less than about 8 riser diameters below the upper end of said reactor vessel thereby providing an initial separation of the spent catalyst from the gaseous products;

c) passing separated catalyst downward through said vessel;

d) maintaining said separated catalyst in said reactor vessel as a dense catalyst bed and passing a stripping gas upward through the reactor vessel;

e) maintaining the upper surface of said dense catalyst bed a distance of less than 16 feet below said riser outlet end;

f) passing said spent catalyst downwardly through said reactor vessel into a stripping zone and contacting said spent catalyst with said stripping gas;

g) passing spent catalyst from said stripping zone into a regeneration zone and contacting said spent catalyst with a regeneration gas in said regeneration zone to combust coke from said catalyst particles and produce regenerated catalyst particles for transfer to said reactor riser;

h) withdrawing a second mixture of gaseous products, stripping fluid, and spent catalyst particles from said reactor vessel through a collector located in said reactor vessel above said dense catalyst bed about the periphery of the outlet end of the riser and transferring said mixture to a particle separator located outside of the reactor vessel, separating gaseous components from said spent catalyst in said separator, and returning said spent catalyst to said reactor vessel, and i) contacting said second mixture with a quench fluid downstream of said reactor vessel and upstream of said particle separator.

2. The process of claim 1 wherein said first mixture is discharged from said riser at a velocity in a range of from 20 to 100 ft/sec.

3. The process of claim 1 wherein said collector is an annular collector.

4. The process of claim 1 wherein said particle separators comprise cyclones.

5. The process of claim 1 wherein the gas components from said first product stream have an average residence time of less than three seconds in said reactor vessel.

6. The process of claim 1 wherein said reactor vessel has a diameter that is between three and five times the diameter of said riser.

7. The process of claim 1 wherein said quench fluid contacts said second mixture in a single conduit between said collector and said particle separator.

8. The process of claim 1 wherein said quench fluid comprises cycle oil.

9. The process of claim 1 wherein said quench fluid comprises light cycle oil.

10. A process for the fluidized catalytic cracking (FCC) of an FCC feedstock, said process comprising:

a) passing said FCC feedstock and regenerated catalyst particles to a reactor riser and transporting said catalyst and feedstock upwardly through said riser thereby converting said feedstock to a gaseous product stream and producing spent catalyst particles by the deposition of coke on said regenerated catalyst particles;

b) discharging a first mixture of spent catalyst particles and gaseous products directly into the dilute phase of a reactor vessel in an upward direction from a discharge end of said riser located from about 1 to about 8 riser diameters below the upper end of said reactor vessel to perform an initial separation of the spent catalyst from the gaseous products;

c) passing separated catalyst downward through said vessel at an average rate of less than 20 $lb/ft^2/sec$;

d) maintaining said separated catalyst in said reactor vessel as a dense catalyst bed and passing a stripping gas upwardly through the reactor vessel at an average superficial velocity of less than about 0.5 ft/sec.;

e) maintaining the upper surface of said dense catalyst bed a distance of between 3 to 16 feet below said riser outlet end;

f) withdrawing a second mixture of gaseous products, stripping fluid, and spent catalyst particles from said reactor vessel through a collector located in said reactor vessel above said dense catalyst bed about the periphery of the outlet end of the riser and transferring said mixture through an external conduit to a particle separator located outside the reactor vessel, separating gaseous components from said spent catalyst in said separator, and returning said spent catalyst to said reactor vessel;

g) passing said spent catalyst downwardly through said reactor vessel into a stripping zone and contacting said spent catalyst with said stripping gas;

h) passing spent catalyst from said stripping zone into a regeneration zone and contacting said spent catalyst with a regeneration gas in said regeneration zone to combust coke from said catalyst particles and produce regenerated catalyst particles for transfer to said reactor riser; and, i) contacting said second mixture with a quench fluid in said external conduit.

11. The process of claim 10 wherein said separated catalyst is passed downward through said reactor vessel at an average rate of at least 15 $lb/ft^2/sec$.

12. The process of claim 10 wherein hot regenerated catalyst is passed to said reactor vessel from said regeneration zone.

13. The process of claim 10 wherein the dilute phase volume of said reactor vessel above the top of said catalyst bed is less than 5 times the volume of said reactor riser between the point where the feed enters the riser and said discharge end.

14. The process of claim 10 wherein said quench fluid contacts said second mixture in a single conduit between said collector and said particle separator.

15. The process of claim 10 wherein said quench fluid comprises cycle oil.

16. The process of claim 10 wherein said quench fluid comprises light cycle oil.

* * * * *